US007242778B2

(12) United States Patent
Csermak et al.

(10) Patent No.: US 7,242,778 B2
(45) Date of Patent: Jul. 10, 2007

(54) HEARING INSTRUMENT WITH SELF-DIAGNOSTICS

(75) Inventors: Brian D. Csermak, Dundas (CA); Jim G. Ryan, Gloucester (CA); Stephen W. Armstrong, Burlington (CA)

(73) Assignee: Gennum Corporation (CA)

( * ) Notice: Subject to any disclaimer, the term of this patent is extended or adjusted under 35 U.S.C. 154(b) by 310 days.

(21) Appl. No.: 10/815,050

(22) Filed: Mar. 31, 2004

(65) Prior Publication Data

US 2004/0202333 A1 Oct. 14, 2004

Related U.S. Application Data

(60) Provisional application No. 60/461,324, filed on Apr. 8, 2003.

(51) Int. Cl.
*H04R 29/00* (2006.01)

(52) U.S. Cl. ..... 381/60; 381/315

(58) Field of Classification Search ..... 381/60, 381/59

See application file for complete search history.

(56) References Cited

U.S. PATENT DOCUMENTS

| | | | | |
|---|---|---|---|---|
| 4,049,930 | A * | 9/1977 | Fletcher et al. | 381/60 |
| 4,575,587 | A * | 3/1986 | Stokes et al. | 381/59 |
| 5,584,869 | A * | 12/1996 | Heck et al. | 607/57 |
| 5,649,032 | A | 7/1997 | Burt et al. | |
| 6,792,114 | B1 * | 9/2004 | Kates et al. | 381/60 |
| 6,879,692 | B2 * | 4/2005 | Nielsen et al. | 381/60 |
| 7,013,015 | B2 * | 3/2006 | Hohmann et al. | 381/318 |
| 2002/0067433 | A1 | 6/2002 | Yui et al. | |
| 2002/0176594 | A1 * | 11/2002 | Hohmann et al. | 381/312 |
| 2003/0007647 | A1 * | 1/2003 | Nielsen et al. | 381/60 |

FOREIGN PATENT DOCUMENTS

| | | |
|---|---|---|
| DE | 4128172 A1 | 3/1993 |
| EP | 0524461 | 1/1993 |
| EP | 0526918 | 2/1993 |
| EP | 0814429 | 12/1997 |
| EP | 1206163 A1 | 5/2002 |
| EP | 1276349 A1 | 1/2003 |
| GB | 2329312 | 3/1999 |

OTHER PUBLICATIONS

European Search Report dated Jul. 10, 2006.

* cited by examiner

*Primary Examiner*—Daniel Swerdlow
(74) *Attorney, Agent, or Firm*—Jones Day

(57) ABSTRACT

In accordance with the teachings described herein, systems and methods are provided for a hearing instrument with self-diagnostics. A detection circuitry may be used to monitor the functional status of at least one transducer by measuring an energy level output of the transducer and comparing the energy level output to a pre-determined threshold level. The detection circuitry may generate an error message output if the measured energy level output of the transducer falls below the pre-determined threshold level. A memory device may be used to store the error message output generated by the detection circuitry.

20 Claims, 5 Drawing Sheets

HEARING INSTRUMENT WITH SELF-DIAGNOSTICS

CROSS-REFERENCE TO RELATED APPLICATION

This application claims priority from and is related to the following prior application: "Hearing Instrument with Self-Diagnostics to Determine Transducer Functionality," U.S. Provisional Application No. 60/461,324, filed Apr. 08, 2003. This prior application, including the entire written descriptions and drawing figures, is hereby incorporated into the present application by reference.

FIELD

The technology described in this patent document relates generally to the field of hearing instruments. More particularly, the patent document describes a hearing instrument with self-diagnostics.

BACKGROUND

In a typical hearing instrument (which may include hearing aids, personal communication ear buds, cell phone headsets, etc.), there is no means to identify the problem when the hearing instrument stops delivering sound into the ear canal. Users might suspect that the battery has died, that one of the transducers has become clogged with debris, or that the device is broken in some manner, however, there is usually no way to determine the cause of the problem without analyzing each element of the hearing instrument separately. A hearing aid, for example, is particularly vulnerable to malfunction resulting from earwax build-up in the outlet port of the hearing aid. However, a malfunction caused by earwax build-up may not be easily detectable by the hearing aid user.

SUMMARY

In accordance with the teachings described herein, systems and methods are provided for a hearing instrument with self-diagnostics. A detection circuitry may be used to monitor the functional status of at least one transducer by measuring an energy level output of the transducer and comparing the energy level output to a pre-determined threshold level. The detection circuitry may generate an error message output if the measured energy level output of the transducer falls below the pre-determined threshold level. A memory device may be used to store the error message output generated by the detection circuitry.

A hearing instrument with self-diagnostics may include at least one hearing instrument microphone for receiving an audio input signal, a sound processor for processing the one or more audio input signals to compensate for a hearing impairment and generate a processed audio signal, at least one hearing instrument receiver for converting the processed audio signal into an audio output signal, and a detection circuitry. The detection circuitry may be operable to monitor an energy level at a node within the hearing instrument and compare the energy level with a predetermined range of energy levels to identify a potential hearing instrument malfunction. The detection circuitry may identify the potential hearing instrument malfunction if the monitored energy level deviates from the predetermined range of energy levels.

A method for detecting a potential hearing instrument malfunction may include the steps of monitoring a configuration of the hearing instrument parameter to determine a normal setting for the hearing instrument parameter; detecting a deviation from the normal setting for the hearing instrument parameter; and automatically generating an error message upon detecting the deviation.

Another method for detecting a potential hearing instrument malfunction may include the steps of monitoring an energy level at a node within the hearing instrument; and comparing the energy level with a predetermined range of energy levels to identify a potential hearing instrument malfunction, wherein the potential hearing instrument malfunction is identified if the monitored energy level deviates from the predetermined range of energy levels.

DETAILED DESCRIPTION

Figure 1:
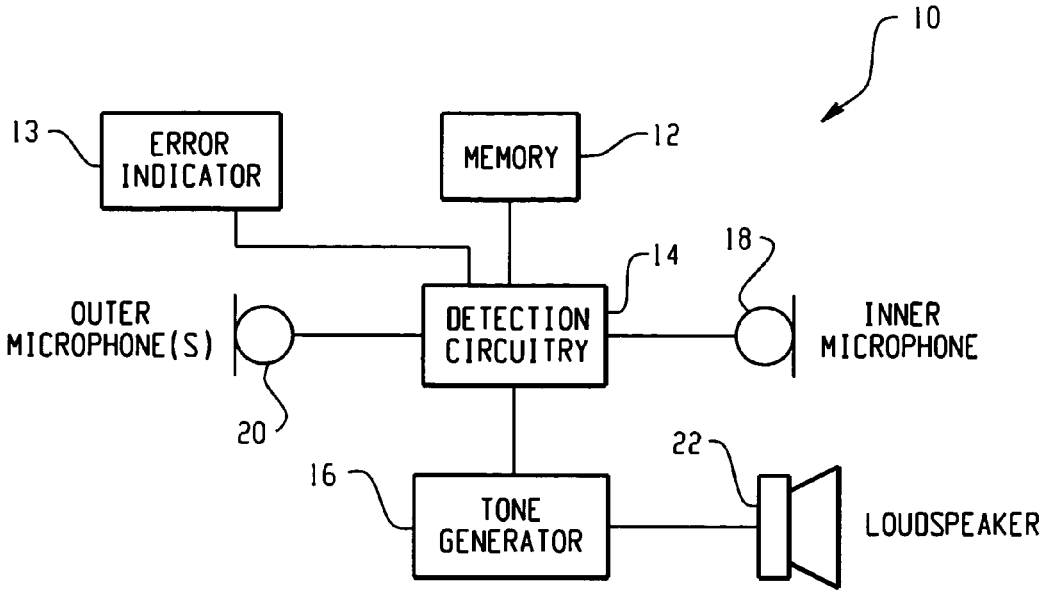
FIG. 1 is a block diagram of an example self-diagnostics system for a hearing instrument.

With reference now to the drawing figures, FIG. 1 is a block diagram of an example self-diagnostics system 10 for a hearing instrument. The self-diagnostics system 10 includes a memory device 12, an error indicator 13, a detection circuitry 14 and a tone generator 16. Also illustrated are a plurality of hearing instrument transducers 18, 20, 22, including an inner microphone 18, one or more outer microphones 20 and a loudspeaker (also referred to as a receiver) 22. The inner microphone 18 and loudspeaker 22 are directed into the ear canal of the hearing instrument user. The outer microphone(s) 20 are external to the ear canal, and may include a single microphone 20 or a plurality of microphones 20.

The detection circuitry 14 is operable to monitor the functional status of the hearing instrument transducers 18, 20, 22 and other hearing instrument components. Upon detecting a possible malfunction, the detection circuitry 14 may store an error message in the memory device 12 and also may cause the error indicator 13 to communicate the possible malfunction to the hearing instrument user. The detection circuitry 14 may include one or more processing device, such as a digital signal processor (DSP), microprocessor, or dedicated processing circuit, and may also include other detection circuitry, such as described below with reference to FIGS. 2–4.

The error indicator 13 may include a display (e.g., an indicator light), a tone generator, or some other means of indicating a possible malfunction to a hearing instrument user. For example, in one embodiment the error indicator may transmit an error tone over a link (wired or wireless) to another hearing instrument in the user's other ear. The memory device 12 may be a non-volatile memory device for storing diagnostic information. Preferably, the data stored in the memory device 12 may be retrieved via a programming port on the hearing instrument. In this manner, stored diagnostic information may be downloaded from the hearing instrument for evaluation by an audiologist, the hearing instrument manufacturer, or others.

Figure 2A:
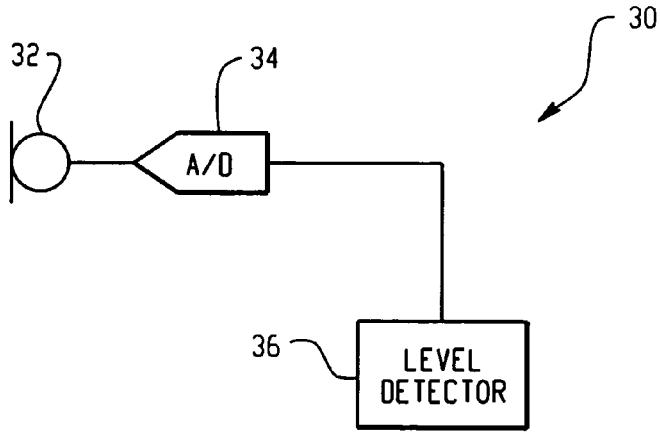
FIGS. 2A and 2B illustrate an example method for monitoring the functional status of a transducer in a hearing instrument.
Figure 2B:
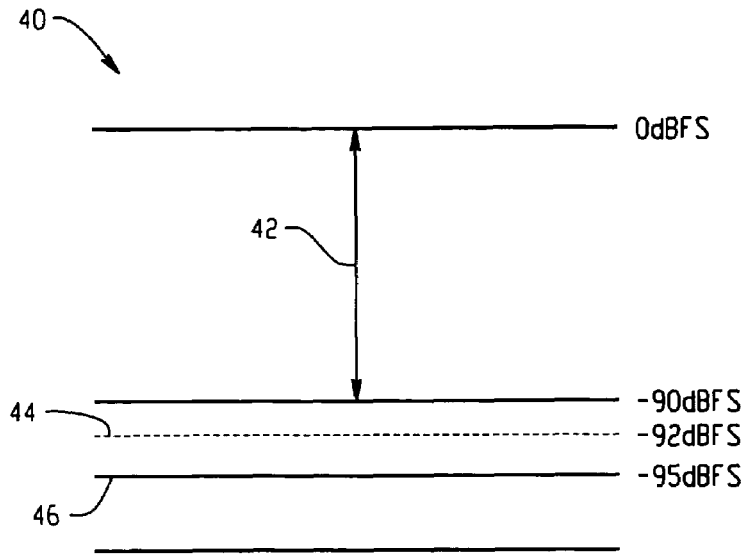

FIGS. 2A and 2B illustrate an example method for monitoring the functional status of a transducer 32 in a hearing instrument. In this example 30, the energy level output (dB full scale (FS)) of one or more hearing instrument microphones 32 are monitored using an analog-to-digital (A/D) converter 34 and a level detector 36. The A/D converter 34 converts the analog output from the microphone into a digital signal, and the energy level (in dBFS) of the digital signal is measured with the level detector 36. The illustrated microphone 32 may, for example, be either the inner microphone 18 or the outer microphone(s) 20 of a hearing instrument, as illustrated in FIG. 1. The A/D converter 34 and level detector 36 may, for example, be included in the detection circuitry 14 of FIG. 1.

In operation, the level detector 36 monitors the energy level of the signal generated by the microphone(2) 32. If the energy level of the microphone signal falls below a pre-determined threshold value (see, e.g., FIG. 2B), then the detection circuitry 14 may record an error message in the memory device 12, cause the error indicator 13 to indicate a possible hearing instrument malfunction, initiate a test of the microphone 32, and/or take some other type of remedial action. An example of a pre-determined threshold value for the energy level of a microphone signal is illustrated in FIG. 2B. In this example 40, the operating range 42 of the microphone 32 falls between 0 dBFS and −90 dBFS (the microphone noise floor.) The threshold value 44, illustrated at −92 dBFS, may be pre-selected below the noise floor of the microphone (−90 dBFS). Also illustrated is an example output level 46 of the AID converter 34. If the microphone output drops below the threshold level of −92 dBFS, then there is a likely transducer malfunction in the hearing instrument.

In one example embodiment, if the inner microphone 18 signal falls below a certain threshold for a pre-determined length of time, then the detection circuitry 14 may send a signal to the tone generator 16 to produce a test tone through the loudspeaker 22. If the inner microphone 18 detects the tone, then a "successful test" result may be logged to the memory device 12. If the tone is not detected, but other environmental, user, or internally generated microphone noise is detected, then a "faulty loudspeaker" result may be logged to the memory device 12. If the signal received from either microphone 18, 20 falls below a predetermined threshold which is equivalent to the internally generated microphone noise, then a "faulty microphone" result may be logged to memory, along with an indication of which microphone 18, 20 had failed to meet the pre-determined criteria.

In another example embodiment, the detection circuitry 14 may instead detect a microphone error by monitoring the current drain caused by the microphones 18, 20. For example, the detection circuitry 14 may directly monitor current drain by measuring the current of the microphone outputs, or may indirectly monitor current drain by monitoring the hearing instrument battery voltage. A variation in current drain in excess of a pre-determined threshold value is an indication of a microphone error.

The example detection circuitry 14, 50 described with reference to FIGS. 1 and 2 may also be used to monitor and maintain the matched frequency responses and sensitivities of two outer microphones 20 used to provide a directional microphone response. Since the two outer microphones 20 in a directional microphone system for a hearing instrument are typically located in close proximity, it is expected that the average sound pressure at each microphone 20 will be very similar over any given period of time. Therefore, if the output of one outer microphone 20 is significantly different than the output of the other outer microphone 20, then the detection circuitry 14 may record an error message in the memory device 12, generate an error alert 13, initiate an auto-calibration sequence, and/or perform some other remedial action.

For example, the detection circuitry 14 may monitor the energy level outputs of the outer microphones 20, and generate an error message if the variance between the two energy levels is greater than a pre-determined threshold. Since sensitivity differences exist between microphones and tend to become worse over time, there may be two different detection threshold levels; one threshold level that indicates a complete failure of the microphone and a second threshold level that indicates the need for a calibration to compensate for the sensitivity difference. If a calibration is triggered, then an auto-calibration sequence may be initiated and the sensitivity difference before and after the calibration may be logged in the memory device 12 to track any microphone sensitivity drift over time. In addition, the microphone mismatch level may be measured and logged on an ongoing and regular basis (regardless of any threshold trigger) as a means of tracking sensitivity drift.

Figure 3:
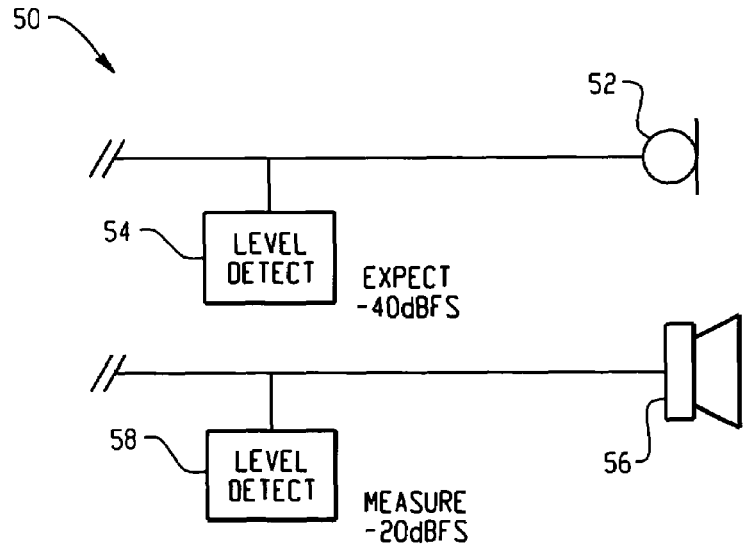
FIG. 3 is a block diagram illustrating an example method for monitoring the functional status of a hearing instrument receiver (loudspeaker)

FIG. 3 is a block diagram illustrating an example method for monitoring the functional status of a hearing instrument receiver (loudspeaker), which may be performed by the detection circuitry 14 of FIG. 1. Since the forward transfer function of the hearing instrument is known to a certain degree of accuracy (which can be increased via a calibration step after fitting), the forward transfer function can be used to predict the signal picked up by the inner microphone 52 at any given moment during operation. A comparison of this inner microphone level estimate with the microphone's actual output may provide a reliable and non-invasive means to monitor the functionality of the hearing instrument receiver (loudspeaker) 56. In the illustrated example, the energy level of the receiver signal (−20 dBFS) is measured by a level detector 58. Based on the forward transfer function of the hearing instrument, the detection circuitry 14 may predict the energy level of the inner microphone (−40 dBFS) resultant from the energy level output by the receiver 56. The actual energy level of the inner microphone signal is measured by the level detector 54. If the difference between the actual level and the estimate falls below a pre-determined threshold, then the detection circuitry 14 may record an error message in the memory device 12, cause the error indicator 13 to indicate a possible hearing instrument malfunction, initiate a test of the microphone 32, and/or take some other type of remedial action.

Figure 4A:
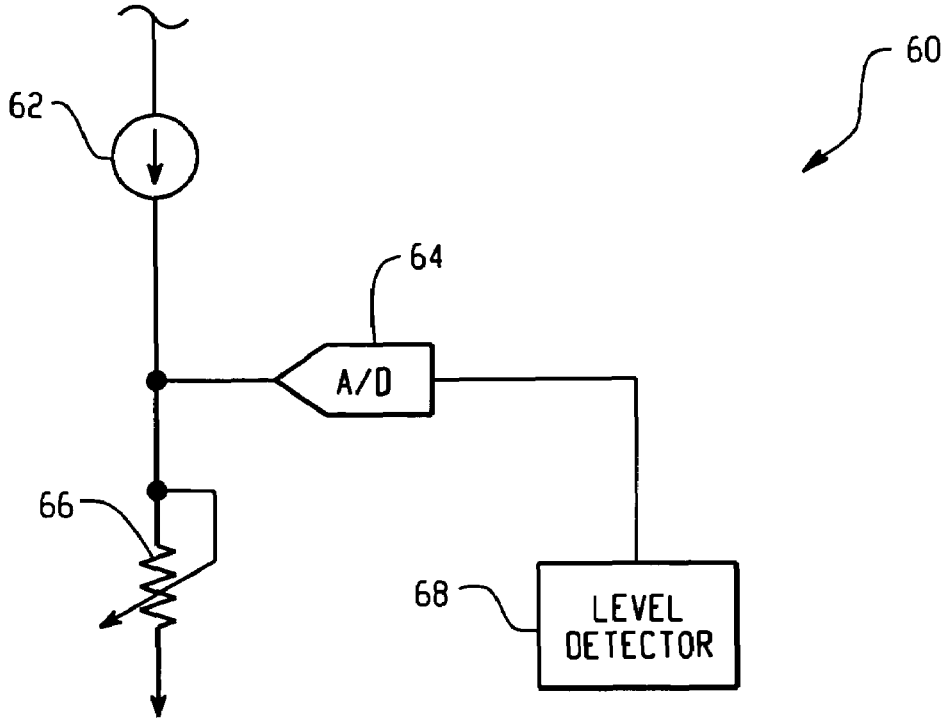
FIGS. 4A and 4B illustrate an example method for monitoring the functional status of the volume control circuitry of a hearing instrument.
Figure 4B:
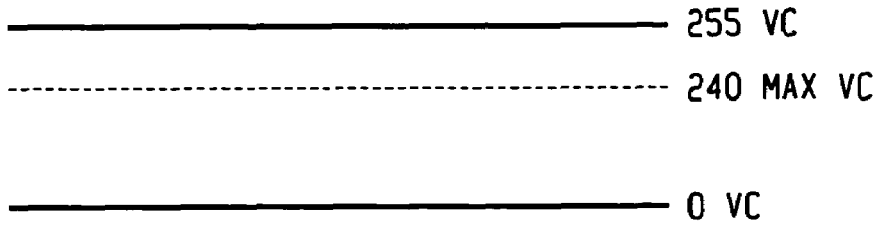

FIGS. 4A and 4B illustrate an example method 60 for monitoring the functional status of the volume control circuitry 62, 66 of a hearing instrument. In this example, the volume control output is monitored by detecting the voltage level across a volume adjustment potentiometer 66 using an A/D converter 64 and a level detector 68. If the volume control (VC) level rises above a maximum VC level, as illustrated in FIG. 4B, then a malfunction may be recorded by the detection circuitry 14. The maximum VC level may, for example, be set my a hearing instrument user, set by an audiologist, or may be automatically set based on past use by the hearing instrument user.

In another example, the detection circuitry 14 may monitor the volume settings of a hearing instrument user over time to determine a normal volume range. The detection circuitry 14 may then record a possible malfunction if the volume control (VC) level deviates from the normal range.

It should be understood that the detection circuitry 14 may monitor the functionality of hearing instrument components other than those specifically described above with reference to FIGS. 1–4. For example, the detection circuitry 14 may maintain a log of user settings (such as volume control, hearing instrument modes, etc.), and generate an error message if a variance from the normal settings is detected.

Figure 5A:
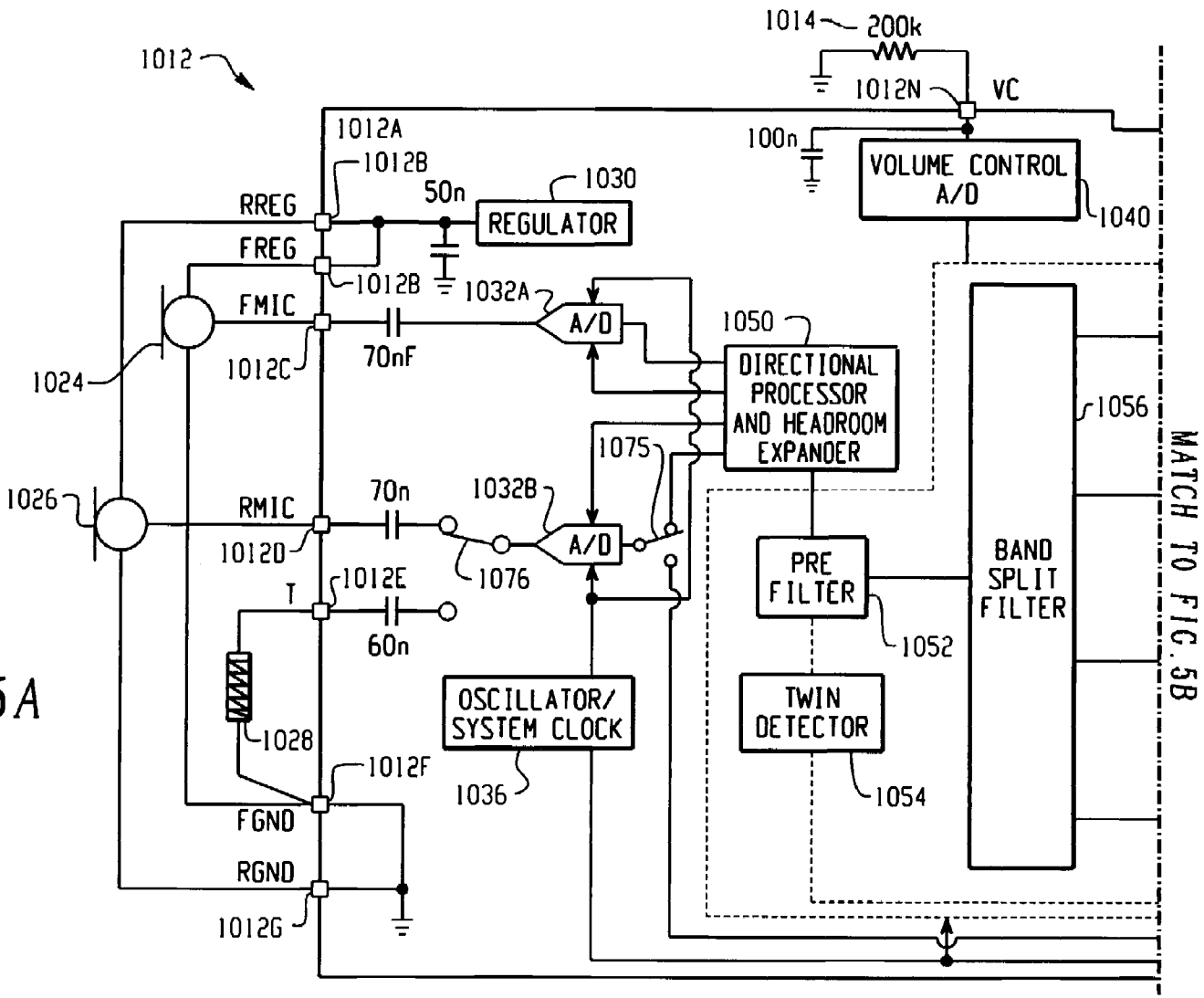
FIGS. 5A and 5B are a block diagram of an example digital hearing aid that may incorporate the self-diagnostics system described herein.
Figure 5B:
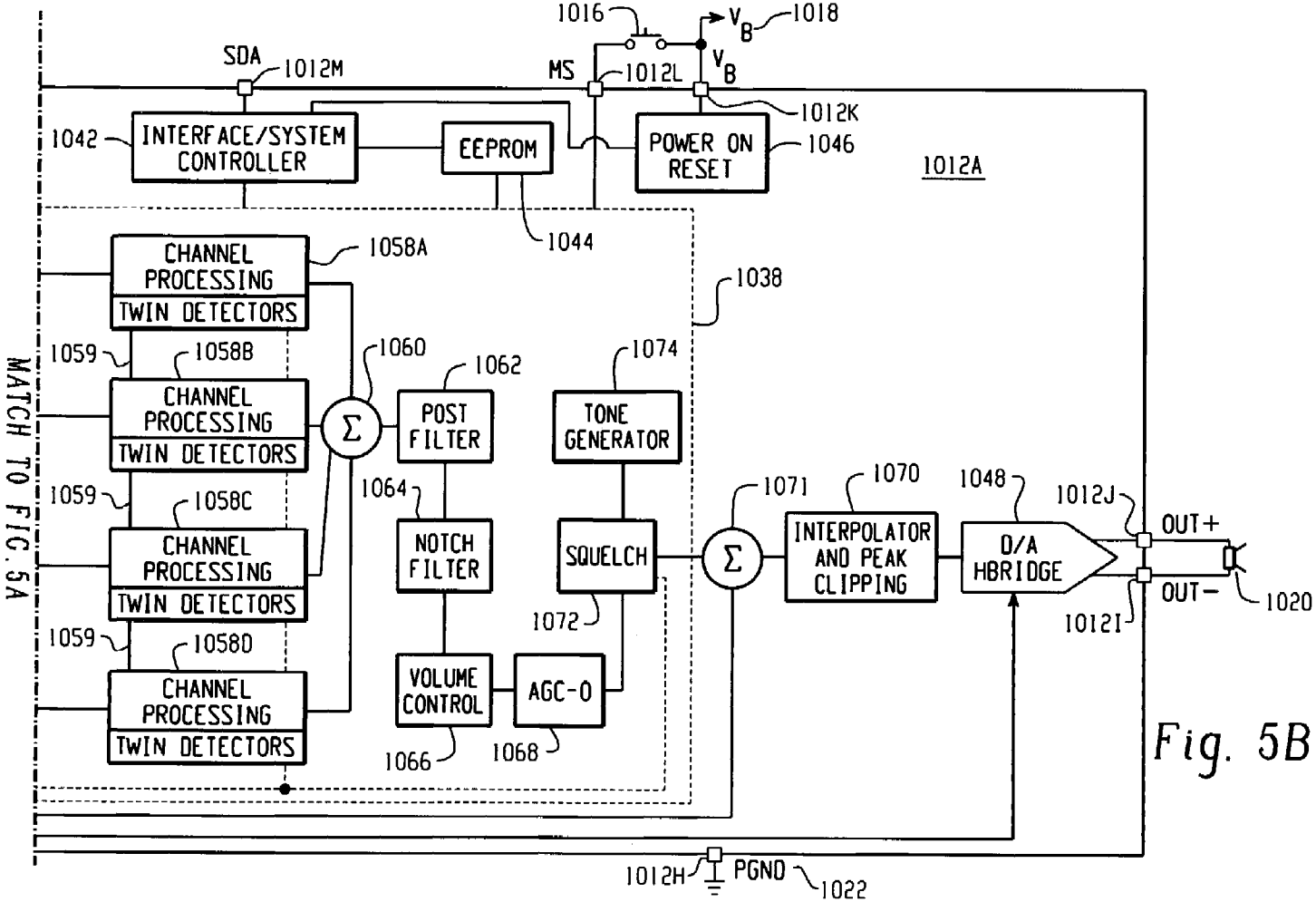

FIGS. 5A and 5B are a block diagram of an example digital hearing aid system 1012 that may incorporate the self-diagnostics system described herein. The digital hearing aid system 1012 includes several external components 1014, 1016, 1018, 1020, 1022, 1024, 1026, 1028, and, preferably, a single integrated circuit (IC) 1012A. The external components include a pair of microphones 1024, 1026, a tele-coil 1028, a volume control potentiometer 1024, a memory-select toggle switch 1016, battery terminals 1018, 1022, and a speaker 1020.

Sound is received by the pair of microphones 1024, 1026, and converted into electrical signals that are coupled to the FMIC 1012C and RMIC 1012D inputs to the IC 1012A. FMIC refers to "front microphone," and RMIC refers to "rear microphone." The microphones 1024, 1026 are biased between a regulated voltage output from the RREG and FREG pins 1012B, and the ground nodes FGND 1012F, RGND 1012G. The regulated voltage output on FREG and RREG is generated internally to the IC 1012A by regulator 1030.

The tele-coil 1028 is a device used in a hearing aid that magnetically couples to a telephone handset and produces an input current that is proportional to the telephone signal. This input current from the tele-coil 1028 is coupled into the rear microphone A/D converter 1032B on the IC 1012A when the switch 1076 is connected to the "T" input pin 1012E, indicating that the user of the hearing aid is talking on a telephone. The tele-coil 1028 is used to prevent acoustic feedback into the system when talking on the telephone.

The volume control potentiometer 1014 is coupled to the volume control input 1012N of the IC. This variable resistor is used to set the volume sensitivity of the digital hearing aid.

The memory-select toggle switch 1016 is coupled between the positive voltage supply VB 1018 to the IC 1012A and the memory-select input pin 1012L. This switch 1016 is used to toggle the digital hearing aid system 1012 between a series of setup configurations. For example, the device may have been previously programmed for a variety of environmental settings, such as quiet listening, listening to music, a noisy setting, etc. For each of these settings, the system parameters of the IC 1012A may have been optimally configured for the particular user. By repeatedly pressing the toggle switch 1016, the user may then toggle through the various configurations stored in the read-only memory 1044 of the IC 1012A.

The battery terminals 1012K, 1012H of the IC 1012A are preferably coupled to a single 1.3 volt zinc-air battery. This battery provides the primary power source for the digital hearing aid system.

The last external component is the speaker 1020. This element is coupled to the differential outputs at pins 1012J, 1012I of the IC 1012A, and converts the processed digital input signals from the two microphones 1024, 1026 into an audible signal for the user of the digital hearing aid system 1012.

There are many circuit blocks within the IC 1012A. Primary sound processing within the system is carried out by the sound processor 1038. A pair of A/D converters 1032A, 1032B are coupled between the front and rear microphones 1024, 1026, and the sound processor 1038, and convert the analog input signals into the digital domain for digital processing by the sound processor 1038. A single D/A converter 1048 converts the processed digital signals back into the analog domain for output by the speaker 1020. Other system elements include a regulator 1030, a volume control A/D 1040, an interface/system controller 1042, an EEPROM memory 1044, a power-on reset circuit 1046, and a oscillator/system clock 1036.

The sound processor 1038 preferably includes a directional processor and headroom expander 1050, a pre-filter 1052, a wide-band twin detector 1054, a band-split filter 1056, a plurality of narrow-band channel processing and twin detectors 1058A–1058D, a summer 1060, a post filter 1062, a notch filter 1064, a volume control circuit 1066, an automatic gain control output circuit 1068, a peak clipping circuit 1070, a squelch circuit 1072, and a tone generator 1074.

Operationally, the sound processor 1038 processes digital sound as follows. Sound signals input to the front and rear microphones 1024, 1026 are coupled to the front and rear A/D converters 1032A, 1032B, which are preferably Sigma-Delta modulators followed by decimation filters that convert the analog sound inputs from the two microphones into a digital equivalent. Note that when a user of the digital hearing aid system is talking on the telephone, the rear A/D converter 1032B is coupled to the tele-coil input "T" 1012E via switch 1076. Both of the front and rear A/D converters 1032A, 1032B are clocked with the output clock signal from the oscillator/system clock 1036 (discussed in more detail below). This same output clock signal is also coupled to the sound processor 1038 and the D/A converter 1048.

The front and rear digital sound signals from the two A/D converters 1032A, 1032B are coupled to the directional processor and headroom expander 1050 of the sound processor 1038. The rear A/D converter 1032B is coupled to the processor 1050 through switch 1075. In a first position, the switch 1075 couples the digital output of the rear A/D converter 1032 B to the processor 1050, and in a second position, the switch 1075 couples the digital output of the rear A/D converter 1032B to summation block 1071 for the purpose of compensating for occlusion.

Occlusion is the amplification of the users own voice within the ear canal. The rear microphone can be moved inside the ear canal to receive this unwanted signal created by the occlusion effect. The occlusion effect is usually reduced in these types of systems by putting a mechanical vent in the hearing aid. This vent, however, can cause an oscillation problem as the speaker signal feeds back to the microphone(s) through the vent aperture. Another problem associated with traditional venting is a reduced low frequency response (leading to reduced sound quality). Yet another limitation occurs when the direct coupling of ambient sounds results in poor directional performance, particularly in the low frequencies. The system shown in FIG. 1 solves these problems by canceling the unwanted signal received by the rear microphone 1026 by feeding back the rear signal from the A/D converter 1032B to summation circuit 1071. The summation circuit 1071 then subtracts the unwanted signal from the processed composite signal to thereby compensate for the occlusion effect.

The directional processor and headroom expander 1050 includes a combination of filtering and delay elements that, when applied to the two digital input signals, forms a single, directionally-sensitive response. This directionally-sensitive response is generated such that the gain of the directional processor 1050 will be a maximum value for sounds coming from the front microphone 1024 and will be a minimum value for sounds coming from the rear microphone 1026.

The headroom expander portion of the processor 1050 significantly extends the dynamic range of the A/D conversion, which is very important for high fidelity audio signal processing. It does this by dynamically adjusting the A/D converters 1032A/1032B operating points. The headroom expander 1050 adjusts the gain before and after the A/D conversion so that the total gain remains unchanged, but the intrinsic dynamic range of the A/D converter block 1032A/1032B is optimized to the level of the signal being processed.

The output from the directional processor and headroom expander 1050 is coupled to a pre-filter 1052, which is a general-purpose filter for pre-conditioning the sound signal prior to any further signal processing steps. This "pre-conditioning" can take many forms, and, in combination with corresponding "post-conditioning" in the post filter 1062, can be used to generate special effects that may be suited to only a particular class of users. For example, the pre-filter 1052 could be configured to mimic the transfer function of the user's middle ear, effectively putting the sound signal into the "cochlear domain." Signal processing algorithms to correct a hearing impairment based on, for example, inner hair cell loss and outer hair cell loss, could be applied by the sound processor 1038. Subsequently, the post-filter 1062 could be configured with the inverse response of the pre-filter 1052 in order to convert the sound signal back into the "acoustic domain" from the "cochlear domain." Of course, other pre-conditioning/post-conditioning configurations and corresponding signal processing algorithms could be utilized.

The pre-conditioned digital sound signal is then coupled to the band-split filter 1056, which preferably includes a bank of filters with variable corner frequencies and pass-band gains. These filters are used to split the single input signal into four distinct frequency bands. The four output signals from the band-split filter 1056 are preferably in-phase so that when they are summed together in block 1060, after channel processing, nulls or peaks in the composite signal (from the summer) are minimized.

Channel processing of the four distinct frequency bands from the band-split filter 1056 is accomplished by a plurality of channel processing/twin detector blocks 1058A–1058D. Although four blocks are shown in FIG. 5, it should be clear that more than four (or less than four) frequency bands could be generated in the band-split filter 1056, and thus more or less than four channel processing/twin detector blocks 1058 may be utilized with the system.

Each of the channel processing/twin detectors 1058A–1058D provide an automatic gain control ("AGC") function that provides compression and gain on the particular frequency band (channel) being processed. Compression of the channel signals permits quieter sounds to be amplified at a higher gain than louder sounds, for which the gain is compressed. In this manner, the user of the system can hear the full range of sounds since the circuits 1058A–1058D compress the full range of normal hearing into the reduced dynamic range of the individual user as a function of the individual user's hearing loss within the particular frequency band of the channel.

The channel processing blocks 1058A–1058D can be configured to employ a twin detector average detection scheme while compressing the input signals. This twin detection scheme includes both slow and fast attack/release tracking modules that allow for fast response to transients (in the fast tracking module), while preventing annoying pumping of the input signal (in the slow tracking module) that only a fast time constant would produce. The outputs of the fast and slow tracking modules are compared, and the compression slope is then adjusted accordingly. The compression ratio, channel gain, lower and upper thresholds (return to linear point), and the fast and slow time constants (of the fast and slow tracking modules) can be independently programmed and saved in memory 1044 for each of the plurality of channel processing blocks 1058A–1058D.

FIG. 5 also shows a communication bus 1059, which may include one or more connections, for coupling the plurality of channel processing blocks 1058A–1058D. This inter-channel communication bus 1059 can be used to communicate information between the plurality of channel processing blocks 1058A–1058D such that each channel (frequency band) can take into account the "energy" level (or some other measure) from the other channel processing blocks. Preferably, each channel processing block 1058A–1058D would take into account the "energy" level from the higher frequency channels. In addition, the "energy" level from the wide-band detector 1054 may be used by each of the relatively narrow-band channel processing blocks 1058A–1058D when processing their individual input signals.

After channel processing is complete, the four channel signals are summed by summer 1060 to form a composite signal. This composite signal is then coupled to the post-filter 1062, which may apply a post-processing filter function as discussed above. Following post-processing, the composite signal is then applied to a notch-filter 1064, that attenuates a narrow band of frequencies that is adjustable in the frequency range where hearing aids tend to oscillate. This notch filter 1064 is used to reduce feedback and prevent unwanted "whistling" of the device. Preferably, the notch filter 1064 may include a dynamic transfer function that changes the depth of the notch based upon the magnitude of the input signal.

Following the notch filter 1064, the composite signal is then coupled to a volume control circuit 1066. The volume control circuit 1066 receives a digital value from the volume control A/D 1040, which indicates the desired volume level set by the user via potentiometer 1014, and uses this stored digital value to set the gain of an included amplifier circuit.

From the volume control circuit, the composite signal is then coupled to the AGC-output block 1068. The AGC-output circuit 1068 is a high compression ratio, low distortion limiter that is used to prevent pathological signals from causing large scale distorted output signals from the speaker 1020 that could be painful and annoying to the user of the device. The composite signal is coupled from the AGC-output circuit 1068 to a squelch circuit 1072, that performs an expansion on low-level signals below an adjustable threshold. The squelch circuit 1072 uses an output signal from the wide-band detector 1054 for this purpose. The expansion of the low-level signals attenuates noise from the microphones and other circuits when the input S/N ratio is small, thus producing a lower noise signal during quiet situations. Also shown coupled to the squelch circuit 1072 is a tone generator block 1074, which is included for calibration and testing of the system.

The output of the squelch circuit 1072 is coupled to one input of summer 1071. The other input to the summer 1071 is from the output of the rear A/D converter 1032B, when the switch 1075 is in the second position. These two signals are summed in summer 1071, and passed along to the interpolator and peak clipping circuit 1070. This circuit 1070 also operates on pathological signals, but it operates almost instantaneously to large peak signals and is high distortion limiting. The interpolator shifts the signal up in frequency as part of the D/A process and then the signal is clipped so that the distortion products do not alias back into the baseband frequency range.

The output of the interpolator and peak clipping circuit 1070 is coupled from the sound processor 1038 to the D/A H-Bridge 1048. This circuit 1048 converts the digital representation of the input sound signals to a pulse density modulated representation with complimentary outputs. These outputs are coupled off-chip through outputs 1012J, 1012I to the speaker 1020, which low-pass filters the outputs and produces an acoustic analog of the output signals. The D/A H-Bridge 1048 includes an interpolator, a digital Delta-Sigma modulator, and an H-Bridge output stage. The D/A H-Bridge 1048 is also coupled to and receives the clock signal from the oscillator/system clock 1036.

The interface/system controller 1042 is coupled between a serial data interface pin 1012M on the IC 1012, and the sound processor 1038. This interface is used to communicate with an external controller for the purpose of setting the parameters of the system. These parameters can be stored on-chip in the EEPROM 1044. If a "black-out" or "brown-out" condition occurs, then the power-on reset circuit 1046 can be used to signal the interface/system controller 1042 to configure the system into a known state. Such a condition can occur, for example, if the battery fails.

This written description uses examples to disclose the invention, including the best mode, and also to enable a person skilled in the art to make and use the invention. The patentable scope of the invention may include other examples that occur to those skilled in the art. For example, in one embodiment, the hearing instrument detection circuitry 14 described above may include a test mode that may be initiated by a hearing instrument user to test one or more of the hearing instrument components. For instance, the test mode may require the user to manually adjust the hearing instrument settings (volume control, directional mode, etc.) and monitor the resultant signals generated by the hearing instrument transducers or other hearing instrument components to detect a malfunction.

The invention claimed is:

1. In a hearing instrument including a plurality of transducers, a self-diagnostics system, comprising:

a detection circuitry operable to monitor the functional status of at least one transducer by measuring an energy level output of the transducer and comparing the energy level output to a pre-determined threshold level;

the detection circuitry being further operable to generate an error message output if the measured energy level output of the transducer falls below the pre-determined threshold level; and a memory device coupled to the detection circuitry and operable to store the error message output generated by the detection circuitry;

wherein the detection circuitry is further operable to generate a test tone that is directed into the ear canal of a hearing instrument user by a hearing instrument loudspeaker, the detection circuitry generating the test tone if the measured energy level output of the transducer falls below the pre-determined level; and the detection circuitry being further operable to monitor an inner microphone to detect the test tone.

2. The self-diagnostics system of claim 1, further comprising:

an error indicator coupled to the detection circuitry and operable to activate an error indicia for communicating a possible transducer malfunction to a hearing instrument user; and the detection circuitry being further operable to cause the error indicator to activate the error indicia if the measured energy level output of the transducer falls below the pre-determined threshold level.

3. The self-diagnostics system of claim 2, wherein the error indicia is an indicator light.

4. The self-diagnostics system of claim 3, wherein the error indicia includes a tone generator that generates an error tone.

5. The self-diagnostics system of claim 1, wherein the transducer is an outer microphone.

6. The self-diagnostics system of claim 1, wherein the transducer is an inner microphone.

7. The self-diagnostics system of claim 1, wherein the hearing instrument includes a programming port, and wherein the error message may be downloaded from the memory device via the programming port.

8. An apparatus comprising:

a hearing aid including an outer microphone configured to be directed outside an ear canal, and an inner microphone and a speaker both configured to be directed into the ear canal, the hearing aid being configured to:

receive sounds through the outer microphone and output the sounds through the speaker;

monitor the energy level that is output by the inner microphone as a function of the sound detected by the inner microphone; and in response to the energy level falling below a threshold value, send an electrical test tone signal to the speaker for the speaker to output a resulting test tone; and sense whether the inner microphone detects the resulting test tone.

9. The apparatus of claim 8 wherein the hearing aid is further configured, after the sense step, to:

generate an indication that the speaker is faulty if other noise is detected by the inner microphone, and generate an indication that the inner microphone is faulty if other noise is not detected by the inner microphone.

10. The apparatus of claim 8 wherein the hearing aid is further configured to generate an indication that the speaker is faulty if the inner microphone does not detect the resulting test tone and other noise is detected by the inner microphone, and generate an indication that the inner microphone is faulty if other noise is not detected by the inner microphone.

11. The apparatus of claim 10 wherein the hearing aid is configured to store the indication in an electronic memory of the hearing aid and to later download the indication through a programming port.

12. The apparatus of claim 10 wherein the hearing aid is configured to communicate the indication to the user through another hearing aid in the user's other ear.

13. An apparatus comprising:

a hearing aid including an outer microphone configured to be directed outside an ear canal and a speaker configured to be directed into the ear canal, the hearing aid being configured to:

receive sounds through the outer microphone and output the sounds through the speaker; and concurrently with the receive and output step and without participation of an external device or person, monitor a performance parameter of the heating aid, determine a malfunction from a value of the parameter, and generate a perceptible indication of the malfunction.

14. The apparatus of claim 13 wherein the parameter is energy level output by the outer microphone.

15. The apparatus of claim 13 wherein the hearing aid has an inner microphone directed into the ear canal and configured to detect the sound output by the speaker, and the parameter is energy level output by the inner microphone.

16. The apparatus of claim 13 wherein the hearing aid is configured to store the malfunction indication in an electronic memory of the hearing aid and to later download the indication through a programming port of the hearing aid.

17. The apparatus of claim 13 wherein the hearing aid is configured to communicate the malfunction indication to the user through another hearing aid in the user's other ear.

18. The apparatus of claim 13 wherein the hearing aid is configured to communicate the malfunction indication to the user.

19. An apparatus comprising:

a hearing aid including a battery for powering the hearing aid, an outer microphone configured to be directed outside an ear canal and a speaker configured to be directed into the ear canal, the heating aid being configured to:

receive sounds through the outer microphone and output the sounds through the speaker and concurrently detect a malfunction in response to a variation in current drain of the battery exceeding a threshold value; and generate an indication of the malfunction.

20. The apparatus of claim 19 wherein the hearing aid is configured to communicate the malfunction indication to the user.

* * * * *